United States Patent [19]

Brown et al.

[11] 4,148,721

[45] Apr. 10, 1979

[54] CENTRIFUGAL CLEANER APPARATUS AND CANISTER TYPE ARRANGEMENTS THEREOF

[75] Inventors: David L. Brown; John Ostborg; Robert O. Wambsgans, all of Springfield, Ohio

[73] Assignee: The Bauer Bros. Co., Springfield, Ohio

[21] Appl. No.: 794,607

[22] Filed: May 6, 1977

[51] Int. Cl.[2] ..... B04C 5/28

[52] U.S. Cl. ..... 209/211; 210/512 M; 55/349

[58] Field of Search ..... 209/211, 144; 210/512 R, 512 M; 55/346, 348, 349, 449, 459 B

[56] References Cited

U.S. PATENT DOCUMENTS

| | | | |
|---|---|---|---|
| 2,125,086 | 7/1938 | Rourke | 209/144 |
| 2,461,677 | 2/1949 | Burdock et al. | 55/348 |
| 2,622,735 | 12/1952 | Criner | 209/211 |
| 2,796,808 | 6/1957 | Scott | 209/211 |
| 3,308,609 | 3/1967 | McCulloch et al. | 55/449 X |
| 3,433,362 | 3/1969 | Robinson | 209/211 X |
| 3,543,931 | 12/1970 | Rastatter | 209/211 |
| 3,724,674 | 4/1973 | Loison | 209/211 X |
| 3,893,914 | 7/1975 | Bobo | 209/211 X |

FOREIGN PATENT DOCUMENTS

| | | | |
|---|---|---|---|
| 877257 | 9/1961 | United Kingdom | 55/346 |

*Primary Examiner*—Ralph J. Hill
*Attorney, Agent, or Firm*—Jerome P. Bloom

[57] ABSTRACT

A cleaner package for receiving materials a constituent or constituents of which are to be separated and/or cleaned includes means defining an inlet chamber and an outlet chamber which are axially spaced and have at least one centrifugal cleaner unit interposed therebetween. The opposite ends of the cleaner unit respectively define a first passage for inflow of said materials thereto and a second passage for outflow of a portion of said materials therefrom. The inflow passage has means defining an inlet exposed to said inlet chamber while the outflow passage is arranged to discharge to the outlet chamber. The initial portion of said inflow passage, including said inlet, is directed in a substantially straight line path, the sense of which is substantially the same as that of the central longitudinal axis of the cleaner. The construction provided enables an easy slip fit mount of the cleaner unit.

The preferred construction of the cleaner unit features an improved separable head wherein said inlet and the following portion of said inflow passage has a configuration enabling the related cleaner to function in a manner to provide increased throughput and cleaning equivalent to that of a conventional side inlet cleaner but with a lower pressure drop. Where the pressure drop is made equivalent to that of a conventional side inlet cleaner it provides improved dirt removal.

28 Claims, 11 Drawing Figures

FIG-10
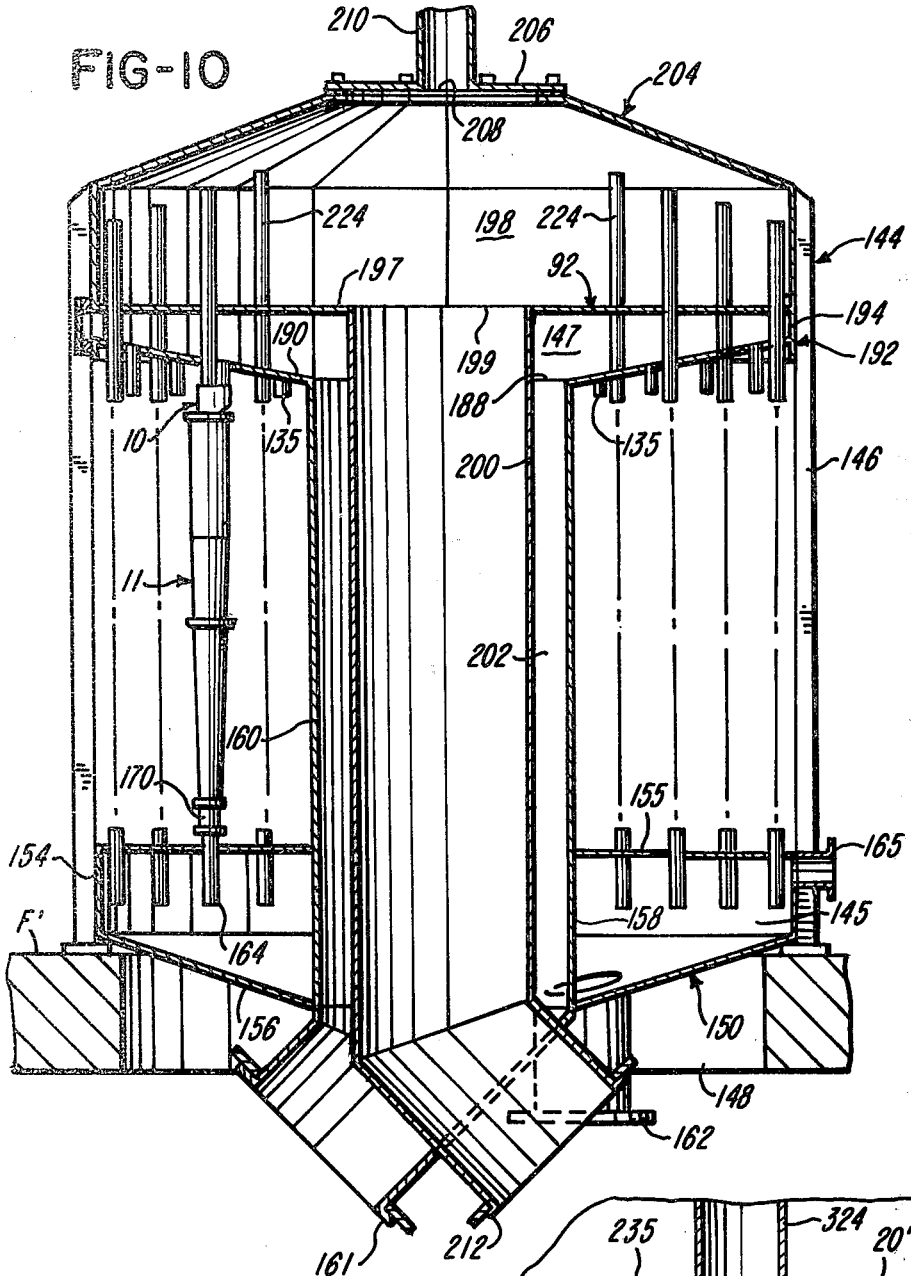
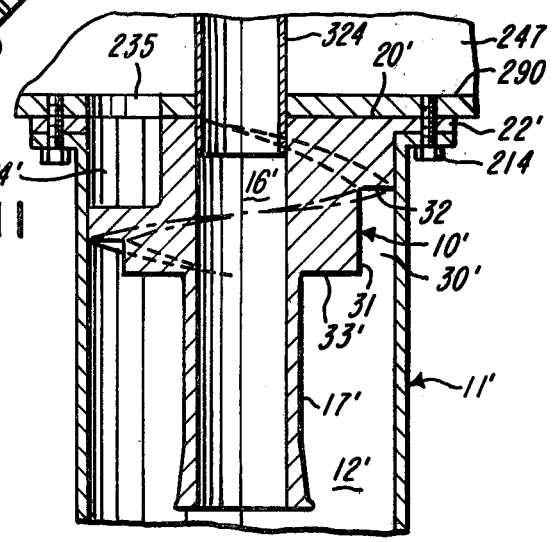
FIG-11

CENTRIFUGAL CLEANER APPARATUS AND CANISTER TYPE ARRANGEMENTS THEREOF

BACKGROUND OF THE INVENTION

This invention relates to improvements in centrifugal cleaners and/or separators and in canister type installations thereof which render such devices economical to fabricate, more efficient and satisfactory in use, adaptable to a wide variety of applications and unlikely to malfunction. Such devices have a wide variety of application not the least of which is their important application to the processing of pulp. In such applications their use is to separate and classify the contents of a pulp slurry into accepts and rejects so that the pulp fibers which are eventually utilized in a paper making, board making or similar process will be clean and well defined and retain optimal strength for the purpose intended.

While the art in question has been highly advanced, it has far from reached a peak. The structure and concepts involved are so simple that the solution of problems encountered in its developing use has proven to be exceedingly difficult, particularly as related to the needs evidenced in the development of associated production techniques in related fields. Basic to the needs and solution of problems evidenced in the use of heretofore known centrifugal cleaners has been the necessity of finding a way to increase their throughput while maintaining and preferably increasing their cleaning efficiency. A lower pressure drop with increased throughput has also been a primary goal of researchers. That a solution to such a problem would be important, particularly in pulp processing, has been well recognized for some time since inherent in the solution would be an ability to achieve better results in a single pass through a centrifugal cleaner. Under such conditions not only would the processing of pulp be expedited but a given processing installation, for a given application and output, would require a smaller number of cleaners, thereby minimizing capital investment, installation and maintenance requirements and costs.

It is to the solution of the foregoing problem that the present invention has been successfully directed.

In addition to the foregoing, other problems have been evidenced in the application of multiple centrifugal cleaners or separators in canister type installations. In such installations, the form and nature of the conventional construction of centrifugal cleaners and/or separators has made them difficult and time consuming to install, particularly in a manner to achieve a compact package. Not only has set up time for a canister type installation been excessive but the nature of the packages so provided have presented plumbing difficulties and high cost in their maintenance. Even more important, prior art canister type installations have not been readily adaptable to a change of application. Such problems are also solved by the present invention.

As far as the present inventors are aware, the following patents are those most pertinent to the present invention:

| | | | |
|---|---|---|---|
| U.S. | 3,724,674 | Loison | April 3, 1973 |
| | 3,105,044 | Troland | Sept. 24, 1963 |
| | 2,719,631 | Vicard | Oct. 4, 1955 |
| | 1,990,943 | Horne et al | Feb. 12, 1935 |
| | 2,956,679 | W. Hoffmann | Oct. 18, 1960 |
| | 3,598,731 | R.H. Frykhult et al | Aug. 10, 1971 |
| | 3,717,255 | Rowland et al | Feb. 20, 1973 |

-continued

| | | | |
|---|---|---|---|
| | 3,335,860 | J. Baxter,Jr. | Aug.15, 1967 |
| | 3,543,931 | Edward L. Raestatter | Dec. 1, 1970 |
| Canada | 677,785 | Freeman et al | Jan. 14, 1964 |
| | 588,344 | Freeman et al | Dec. 8, 1959 |
| Norway | 103,815 | Voith | Feb. 22, 1964 |

While the noted patents flirt, to some extent, with the noted problems, they do not afford either the particularly advantageous solutions or the construction for centrifugal separators and/or cleaners and canister type installations thereof as achieved by the present invention.

SUMMARY OF THE INVENTION

For convenience of disclosure, the phrase "centrifugal cleaner", as herein employed, refers to any and all devices having the nature of centrifugal type cleaners or separators.

One development of the present invention is a structural arrangement providing simple and highly improved "top inlet" centrifugal type cleaners featuring a unique head portion which may be readily interchanged in accordance with the changing needs of a particular installation or application. In accordance with the invention this head may be readily applied (in preferred embodiments without tools) to form an axial extension of one end of a conical or other configured shell which defines therewith a centrifugal separating chamber. The end of the head which positions outermost of the separating chamber has a feed inlet opening the direction of which is generally the same as that of the central axis of the head and the central longitudinal axis of the associated separating chamber. The inner end of the relatively short inlet passage defined by the feed inlet opening is merged with and opens laterally to a helically configured flow channel the base of which faces away from the head end which embodies the inlet opening and forms a guiding surface for inflowing material to move through the head to the associated separating chamber. At the end of this flow channel which connects with the inlet passage, the head is formed to produce therein a flow restricting passage of short longitudinal extent which forms a bridge between the inlet and the following portion of the flow channel which in accordance with the invention is exposed to and forms part of one end of the separating chamber which it caps. In the example illustrated the arcuate extent of the flow restricting passage is approximately 90° and its depth to width ratio is maintained in the neighborhood of 3/1 for maximum performance while the exposed portion of the flow channel extends approximately 360°. In the preferred embodiment illustrated the flow channel is relatively deep until the terminal portion thereof from which the inflowing material is discharged to the separating chamber. Thus, the invention head provides a "roof" surface for the separating chamber which has a spiraling channel-like configuration and the material to be separated is led through the head in an axial sense. This arrangement is in distinct contrast to the construction afforded in use of a conventionally provided tangential inlet to the body or head of a centrifugal cleaner. Moreover it provides distinct and unexpected advantages.

Input to the centrifugal cleaners of the invention may be achieved merely by flowing any fluid, liquid and/or solid composite, elements of which are to be separated, over and across one end of its inlet passage or an axial extension thereof. The arrangement is such that pressure or power necessary for throughput of a given amount of material to be separated is minimized and throughput per unit time may be significantly increased, if so required. The top inlet arrangement also permits, where desired, a larger inlet opening than is normally possible with the tangential inflow construction of prior art cleaners. The invention construction also minimizes energy losses and undesirable side effects on the contents of a flow directed to the shell attached to the head, within which shell, per se, the orbiting of the materials introduced is smoothly developed in a natural manner. It has been found that the cleaning or separating efficiency of a centrifugal cleaner embodying the invention concepts is significantly enhanced by the arrangement here provided.

Of particular importance in preferred embodiments of the invention cleaner is the narrow relatively deep channel which is provided for inflowing material. This permits a very quick movement of undesirable foreign material to the outside wall of the channel. In the embodiment illustrated the cross sectional area of the enclosed portion of the passage in the cleaner head is maintained constant, with a resultant reduction in pressure drop in the transition of the material from the round inlet portion of the opening through the head to the portion which has a rectangular cross section. The enclosure of the axially extending helically formed flow channel in the head as here provided eliminates the possibility of heavy material cycling at the top of the cleaner and causing the excessive wear which is a problem in conventional cleaners.

The use of a long narrow helical inlet in preferred embodiments permits the use of larger inlet and discharge openings due to the increased effectiveness of dirt removal which is enabled by the invention features. A result of this construction is an increase in the capacity of a cleaner of a given size.

Apart from the foregoing, the invention concepts enable a highly improved plug-in type centrifugal cleaner assembly which requires neither supply hoses nor clamps. This last minimizes the normally anticipated time, labor and cost in installing a canister type package of centrifugal cleaners. In a preferred embodiment, a canister type installation in accordance with the invention resembles a carrousel. In the arrangement illustrated the invention units are installed between two slurry carrying chambers to provide a clean, neat compact highly efficient package lending ease and simplicity in its setup, maintenance and use.

The preferred embodiments of the canister-type package per the present invention feature sloping dividers forming the base of the supply chamber. This provides for ease of cleaning as well as maintaining a velocity in the delivery of materials to the supply chamber which is sufficient to prevent solids from settling. The canister type package lends particular ease in reference to enabling the application of vacuum to both the accepts and rejects of the cleaner.

A primary object of the invention is to provide improvements in centrifugal cleaners and separators and canister type packages thereof rendering them simple to fabricate, more efficient and satisfactory in use, adaptable to a wide range of applications and unlikely to malfunction.

Another object of the invention is to provide centrifugal type cleaners having an increased throughput capacity and achieving a cleaning efficiency which is proportionately greater than that achieved by the centrifugal cleaners of the prior art which have a lesser throughput capacity.

A further object of the invention is to provide unique centrifugal type cleaners featuring an improved head construction having an inlet the opening to which may be fed by passing the material to be separated over and/or across said opening.

An additional object of the invention is to provide improvements in canister type installations of centrifugal cleaners or separators which may be assembled and serviced essentially without tools.

Another object of the invention is to provide centrifugal cleaners, elements and canister type packages thereof possessing the advantageous structural features, the inherent meritorious characteristics and the means and mode of use herein described.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the accompanying drawing wherein is shown one but obviously not necessarily the only form of embodiment of the invention, FIG. 1 illustrates a canister type cleaner in accordance with the present invention embodied in a package having a carrousel form, the construction being generally diagrammatically illustrated in a vertical sectional view wherein parts are eliminated for clarity of disclosure;

FIG. 10 is a view similar to FIG. 1 showing a modification of the package there illustrated; and FIG. 11 is a fragmentary sectional view illustrating a further modification of a package per the present invention.

Like parts are indicated by similar characters of reference throughout the several views.

Figure 3:
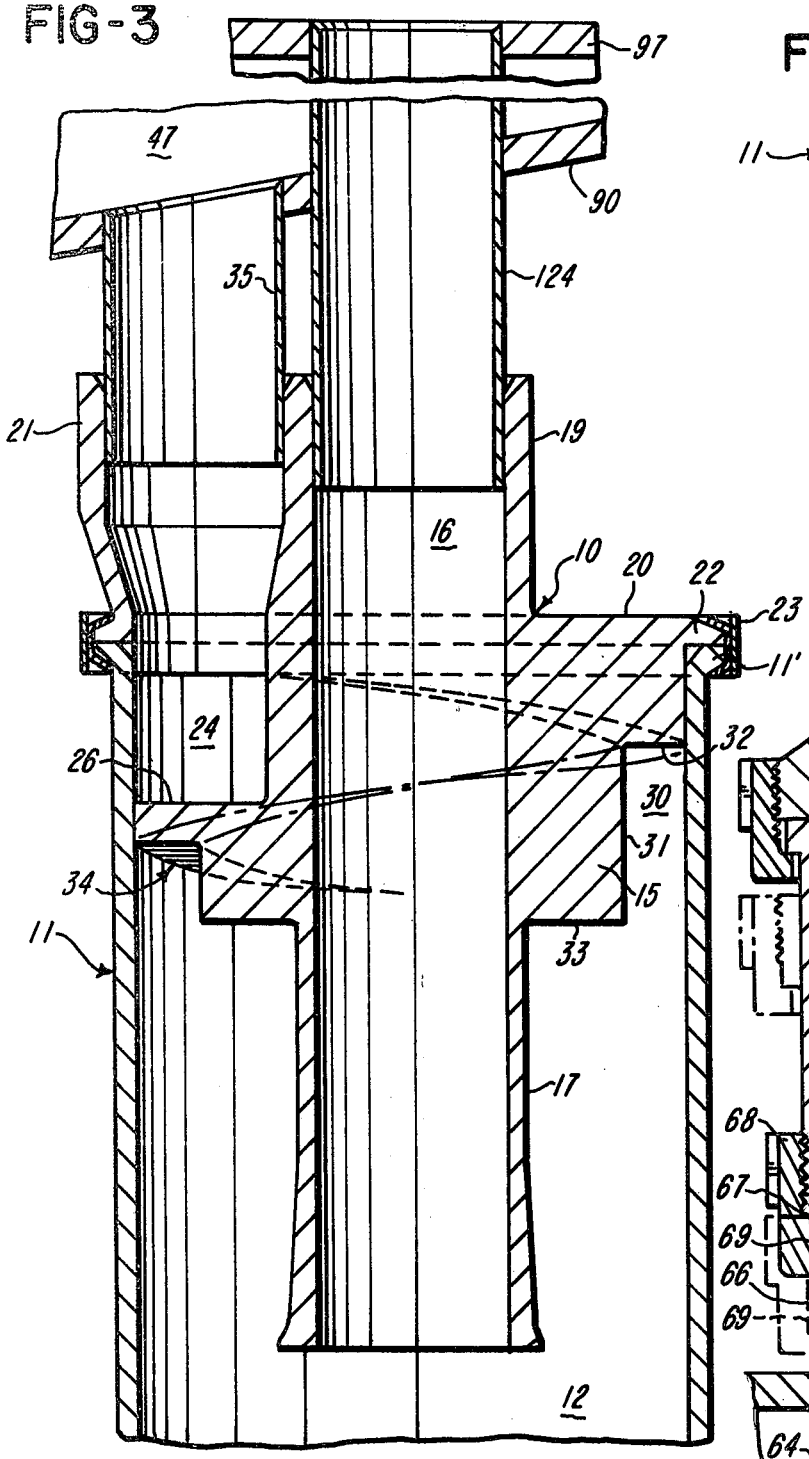
FIG. 3 is a fragmentary vertical section (relatively enlarged) of the head portion of a single cleaner, as embodied in the construction of FIG. 1.
Figure 7:
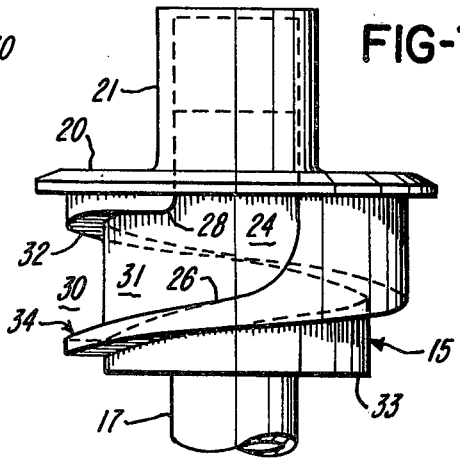
FIG. 7 is a side elevation view of the head taken on line 7—7 of FIG. 6 with its housing removed.

FIGS. 3 to 9 illustrate a basic element of preferred embodiments of centrifugal cleaners in accordance with the present invention, in the form of an easily applied and easily replaceable head 10. As seen in FIGS. 3 and 7, the head 10 caps and forms an axial extension of the head end of a shell 11 which defines therewith a centrifugal separating chamber 12. The shell 11 may have various tubular configurations but for the purposes of the present disclosure it is illustrated to have an upper or head end portion 13 which is cylindrically configured and a lower end 13' which is conically convergent to its projected extremity. The latter is truncated to define a rejects or discharge opening 14.

The head 10 is molded or cast of plastic or such other material as may be suitable for the intended application. The main body portion 15 thereof has a generally cylindrical outer configuration and includes a central axially directed passage 16 extended at one end by a relatively thin walled tubular projection 17 formed to resemble the entrance end of a bell type overflow nozzle. The opposite end of the passage 16 is axially extended by a tubular projection 19 paired and integrated, at one side thereof, with a second generally tubular projection 21 defining an entrance to a flow channel formed in and extended through the main body of the head 10. The base ends of the projections 19 and 21 merge with a planar surface 20 extending transversely of and defining one end of the body portion 15. The outer periphery of the surface 20 is radially extended by a circular flange 22 forming an external projection from the outer surface of the body portion 15.

In its application, the head 10 is inserted in the head end 13 of the shell 11, with the projection 17 as its leading end. The arrangement is such to provide that the body portion 15 nests interiorly of the shell with its outermost cylindrical surface portions bearing on the inner wall of the shell and its flange 22 extended over and seated in end abutted relation to a similar flange 11' rimming the opening to the head end of the shell. Suitable sealing means may be applied between the flanges 22 and 11', if such is deemed necessary, whereupon these flanges will be simply interconnected by the application of a clamping band 23. The band 23 is generally U-shaped in cross section and conventionally constructed and applied to encompass, contain and clamp together the abutted flanges 22 and 11'. Since the detail of the clamping band 23 is conventionally contrived and well known to those versed in the art, such detail is not further described.

The innermost end of the tubular projection 21 opens to a pocket or recess 24 directed inwardly of the body portion 15, the opening to which pocket is essentially in a transverse plane of the head which is occupied by the surface 20. The direction of the pocket 24 is in a sense parallel to and it is spaced radially outward from the central longitudinal axis of the head. The pocket 24, which is outwardly extended by the projection 21, defines a feed inlet to the flow channel formed in the body portion 15.

Adjacent its base 26, the peripheral wall of the pocket 24 has an opening 28 communicating its interior with the entrance end of the flow channel 30 in the body portion 15. The channel 30 is helically configured and is formed in and about the outer periphery of the body portion 15. In the orientation shown in the drawings, the base surface 32 of the channel 30 is uppermost and facing in the direction of that portion of the head incorporating the projection 17. The forming of the channel 30 produces on the exterior of the body portion 15 a wall structure 34 which provides an extension of the base of the pocket 24. The structure 34 extends outwardly, transversely of and in bridging relation to the channel 30, in an underlying generally spaced relation to the surface 32. The surface 32 is itself helically configured and is formed, in part, by the surface portion of the wall structure 34 which faces in the direction of the projection 17. The arcuate extent of the surface of the structure 34 which faces the surface 32 is relatively short and terminates about 90° from that point at which it connects to the base 26 at the opening 28. The inner wall surface of the shell 11 provides an outer side wall for the channel 30 when the head 10 is inserted in the shell while its opposite and parallel side 31 is provided on the body portion 15 in a manner believed clear from the drawings. The arrangement described provides a restricted flow passage within the limits of the wall structure 34 which communicates at one end with the pocket 24 and at the other end with that portion of the flow channel in the head which is beyond the wall structure 34. Beyond the wall structure 34 the channel has an arcuate extent of approximately 360°. This 360° portion of the channel opens at its bottom from the discharge face 33 of the main body portion of the head 10 and the channel is thereby exposed to the interior of the separating chamber 12 when the shell 11 is capped by the head 10.

Considering that the head 10 has been inserted in the shell as shown in FIG. 3, channel 30 has a generally rectangular cross section and in accordance with the present invention the height or depth of the channel with respect to its width, in the restricted flow passage portion thereof which connects the pocket 24 with the exposed portion of the channel, is at a ratio of approximately 3 to 1. Within this restricted flow passage the cross sectional area of the channel is essentially constant, thereby avoiding a resultant reduction in pressure drop in the transition of the flow from the environment of the pocket 24 to the exposed portion of the flow channel. The narrow character of the flow channel is maintained beyond the restricted flow passage and this permits that the inflowing material which is accelerated as it is directed from the pocket 24 into the exposed portion of the flow passage assumes a flow pattern wherein there is a substantially immediate movement of undesirable or heavy particles in the incoming material to the outer peripheral wall of the channel. The benefit of this will be further described.

The nature and configuration of the head, as illustrated, avoids the possibility of heavy particles in the incoming material cycling adjacent the top of the separating chamber and causing excessive wear which is often times experienced in the use of conventional cleaners.

As will be observed in the drawings, the depth of the channel 30 is substantial and generally maintained the major portion of its helical extent. However its depth is rapidly reduced at its discharge end the terminal portion of which coincides with the projected extremity of the under surface portion of the wall structure 34. Note that the terminal projected edge portion of the wall structure 34 lies in a plane which is adjacent but in spaced parallel relation to the discharge end 33 of the body portion 15.

Summarizing the above with reference to FIG. 3, on slip fit of the body portion 15 of the head 10 to the shell 11, the inner wall surface of the shell automatically provides an outer side wall for the channel 30 which is in parallel spaced relation to its inner side wall 31 formed in the body portion 15. At the same time a portion of the inner wall surface of the shell 11 provides a side closure for that initial portion of the channel which defines the restricted flow passage the depth of which is three times its width. It is in this initial enclosed portion of the flow passage wherein incoming material is first influenced to accelerate to a high velocity flow and in the process to acheve a full vortex type flow pattern. By reason of the narrow width of the channel, heavy or undesirable material contained in the flow is caused to move directly to an area adjacent the inner wall surface of the shell. Once having reached the outer side wall of the channel the position of the heavy and/or undesirable particles in the flow will be influenced by the induced velocity of the flow to maintain their positions as they move about the head and into and through the chamber 12, the length thereof.

Since the pocket 24 positions to open in a sense axially and from one end of the shell in which the head 10 is inserted, all one has to do to direct slurry to the chamber 12 is to move the slurry over and/or across an opening to the pocket 24 or an extension thereof. In the case illustrated in FIG. 3, the pocket is axially extended by both the projection 21 and a tube 35 over one end of which this projection is slip fit. As shown, the opposite end of the tube 35 is fixed to rim an opening to a supply chamber 47 which receives a flow of material the contents of which are to be separated in the shell 11. It will be obvious that as slurry moves across the end of the tube 35 which opens to the supply chamber, the slurry will simply drop through this tube in the projection 21 and freely enter the pocket 24. By way of the lateral opening 28 the slurry will then pass to and through the flow accelerating restricted portion of the channel 30 and be influenced as previously described to move into and through the separating chamber 12 in a condition free of turbulence. During the time the slurry is contained on all sides by the restricted flow passage portion of the channel 30 it will inherently develop a velocity which is predeterminable for a given flow. The velocity so developed influences a continuing inflow of the material directed to the supply chamber 47 to and from the pocket 24.

The foregoing details a preferred embodiment of a separable head for a centrifugal cleaner the benefits of which will be particularly evident with reference to the following description of selected applications.

The illustrations of FIGS. 1 through 9 demonstrate a canister type package of improved centrifugal cleaners having a simple but highly advantageous construction. This package embodies a plurality of centrifugal cleaner units including a shell 11 capped by a head 10 as previously described. The centrifugal cleaner units are embodied within and extend in a sense vertically of a frame 44. This frame includes means defining two slurry chambers 45 and 47 mounted in vertically spaced relation by a plurality of pairs of vertically oriented beams 46 which are circularly and equidistantly spaced. In the example illustrated, the lower ends of the beams 46 are suitably anchord to, and about an opening 48 in a floor F.

The chamber 45 is defined by a tank 50 which has an annular configuration. The tank 50 includes an outer cylindrically configured vertical wall portion 54, a horizontal annular top wall portion 55 and a bottom wall portion 56 comprised of a conically convergent wall section bridged at its lower apex end by an annular plate 59 which is parallel to the top wall 55. The conically configured bottom portion of the tank depends interiorly and centrally of the opening 48 in the floor F. The inner peripheral wall 58 of the tank is provided by part of a vertically oriented tube 60 the lower end of which extends beyond and below the bottom of the tank. The dependent extremity of the tube 60 is provided with an external flange 61, by means of which it is adapted to be coupled, by suitable conduit means, to a source of slurry the contents of which are to be separated and/or cleaned by passage thereof through the chambers 12 of the centrifugal cleaners embodied in the frame 44.

The top wall of the tank 50 is provided with a plurality of apertures 63 arranged in concentric rings, in each of which rings the apertures are circularly and equidistantly spaced. One aperture is provided for each of the centrifugal cleaner units installed in the frame 44.

As shown, the tank 50 defines an annular rejects chamber 45 a discharge opening from which is rimmed by a tube 62 the projected extremity of which has an external flange. This latter flange provides means for coupling thereof to suitable conduit means serving to direct rejects from the tank for further processing as and where needs require.

Adjacent the top wall 55, the side wall of the tank 50 includes an opening rimmed by a tubular adapter 65 including a flange providing means for coupling thereto of a conduit means for connecting a source of vacuum with the top of the chamber 45. Such vacuum is conventionally utilized as and when required, in a manner and for purposes well known to those versed in the art. Further openings in the side wall 54 are provided with sight glasses, as required for observation of rejects issuing from the centrifugal cleaners embodied in the frame 44. In the illustration demonstrated in FIGS. 1 through 9 each of the aperture 63 accommodates a tube 64 the outer wall surface of which has a sealed connection to the top wall 55. The major portion of the axial length of each tube 64 depends within the chamber 45, perpendicular to the top wall 55, while a relatively shorter portion of its length projects upwardly from the wall 55 and perpendicular thereto.

A short tube segment 66 having an external flange 67 is slip fit in each tube 64 to have its flange 67 seat over and abut the uppermost end of the associated tube. The limiting function of the flange 67 is believed obvious. The flange 67 serves as a base for seating one end of a sight glass 70 which is positioned to form an axial and upwardly directed extension of the tube segment. A thread is formed in the outer peripheral surface of the sight glass 70 at its lowermost end, while its uppermost end is provided with an externally projected circular flange 71.

In the embodiment of the invention here described the conically convergent lower apex end portion of each shell 11 is provided with an external flange 72 having a thread on its outer periphery. The diameter of the flanged apex end of the shell is such that it is slightly greater than the diameter of a sight glass 70 at that end including the flange 71. As may be seen from FIG. 4, in the application of a centrifugal cleaner including a shell 11 and head 10 the cleaner is applied so the flanged end of the shell seats to the upper flanged end of a sight glass 70, with which glass the shell is coaxially aligned.

Prior to application of a sight glass 70 in stacked coaxial relation with a tube segment 67 and a tube 64 in which it nests, a cup-shaped nut 68 is positioned for free rotation about the upwardly projected portion of the tube 64. The configuration of the nut 68 provides it with an internal flange forming a shoulder 69 facing upwardly of and in immediately rimming relation to the outer surface of the tube 64 and a peripheral wall the inner and upper surface portion of which is threaded and adapted for a threaded engagement with and about the threaded outer surface at the lower end of the associated sight glass 70. As will be seen, once the sight glass 70 is stacked on the flange 67 of the tube segment 66, the nut 68 can be moved upwardly to cup about the outer peripheral portion of the flange 67 and to threadedly engage with and tie the sight glass 70 to a coaxially aligned and relatively fixed relation with respect to the tube segment 66. A second similarly constructed nut 68' is positioned for free rotation about the sight glass 70 above the nut 68 and adapted to be moved upwardly thereof to cup under and about the flange 71 at the upper end of the sight glass and threadedly engage to the threaded outer periphery of the flange 72. With the arrangement thus provided, one can simply and easily connect a sight glass and a cleaner in a coaxial alignment with a tube segment 64 without the need for any special tools. Of course, where circumstances so require, suitable seals may be provided between the assembled parts.

Figure 4:
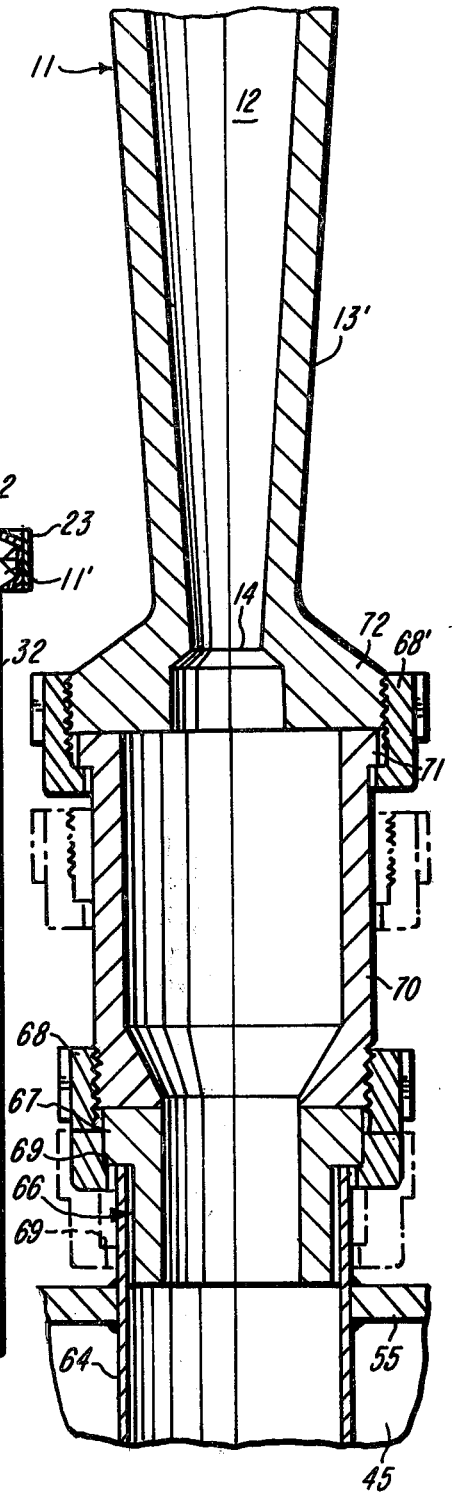
FIG. 4 is a fragmentary sectional view (relatively enlarged) of a portion of a single cleaner taken on line 4—4 of FIG. 1.
Figure 5:
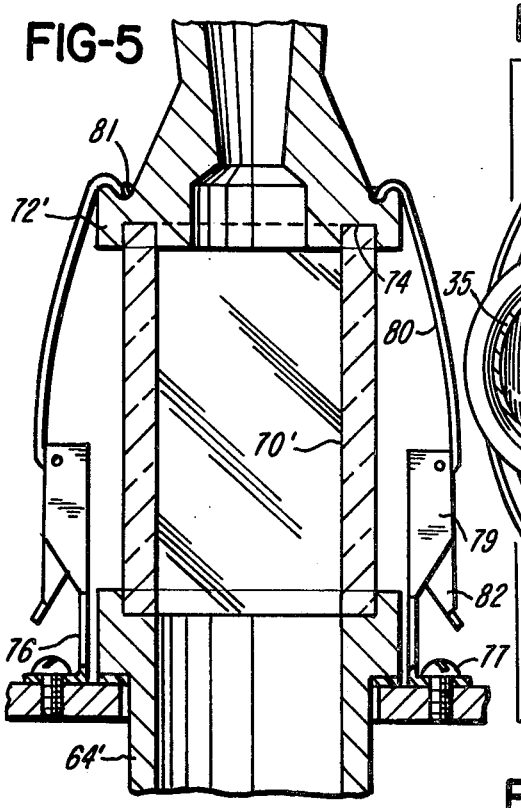
FIG. 5 is a view similar to that of FIG. 4 showing a modification of the construction there illustrated.
Figure 6:
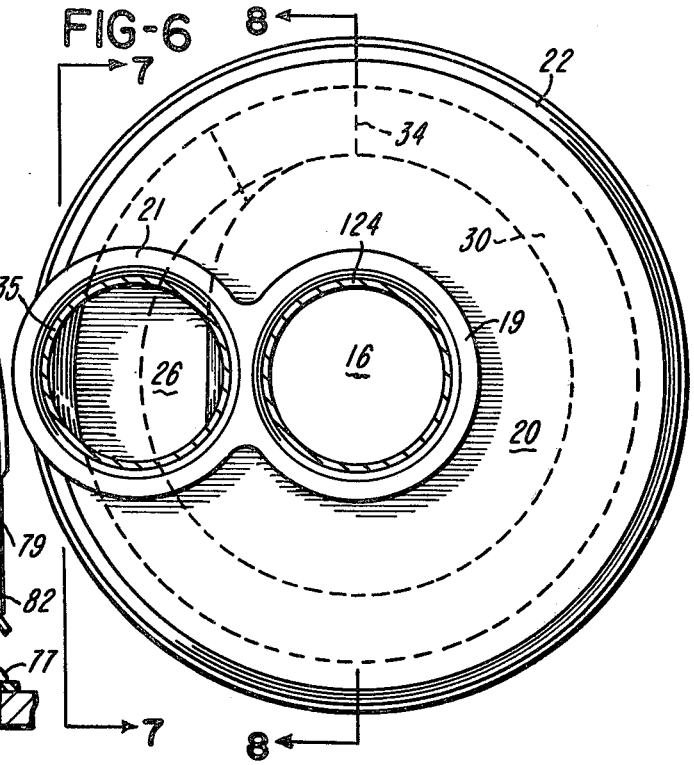
FIG. 6 is a top view of the head of a preferred embodiment of a centrifugal cleaner in accordance with the invention, such as utilized in the installations of FIGS. 1 and 10.
Figure 8:
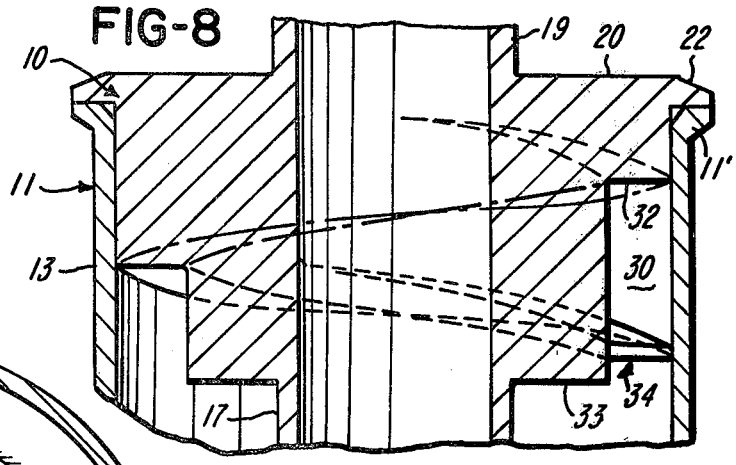
FIG. 8 is a fragmentary view taken on line 8—8 of FIG. 6 showing the head in an installed position.
Figure 9:
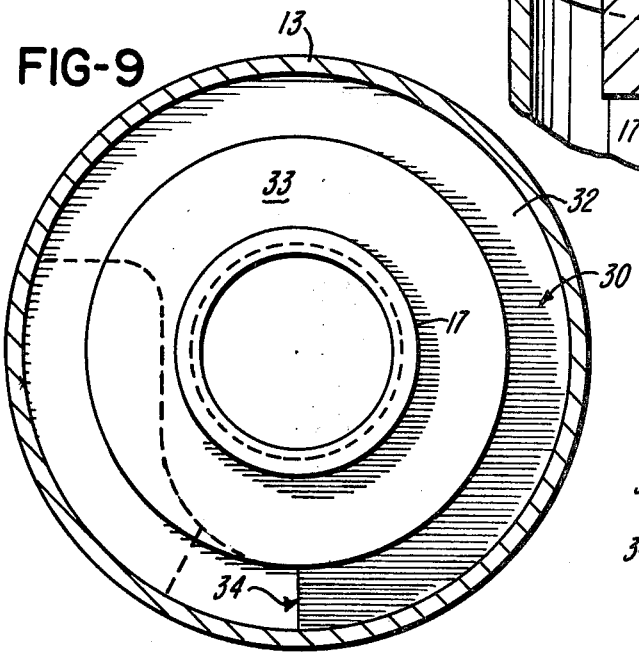
FIG. 9 is a bottom view of the head shown in FIGS. 6 and 7.

As an alternative to the connection of the lower ends of the cleaners as illustrated in FIG. 4, see FIG. 5 of the drawings. In this case, in lieu of a straight tube 64 as described with reference to FIG. 4, each of the apertures 63 accommodates a tube 64' the uppermost end of which has an external flange. The arrangement is such that each of the tubes 64' may be simply dropped through an opening 63 and positioned to depend interiorly of the chamber 45 to an extent determined by the engagement of its flange with the top wall of the tank 50. Suitable sealing means are provided between the tube flange and the top wall of the tank, in a manner and for purposes believed obvious.

The uppermost flanged end of each tube 64' is counterbored to form an annular recess in its inner wall surface, affording a shoulder which seats the lower end of a sight glass 70'. The lower end of the sight glass 70' is thus nested in the counterbore portion of the tube 64' and so contained thereby that the sight glass forms a coaxial and upwardly directed extension of the tube 64'.

In the modification shown in FIG. 5, the conically convergent lower end portion of the shell 11 is provided with an external flange 72' having in its lowermost surface an annular groove 74 designed to have slip fit therein and to nest the uppermost end of the sight glass 70, as illustrated.

The uppermost surface of the flange 72' has a circular groove 81.

Positioned adjacent the outermost peripheral surface of the flanged upper end of the tube 64' in each case and slightly outwardly thereof, at each of diametrically oppostie positions, is a right angled bracket 76, the short leg portion of which seats to the upper surface of the wall 55 of the tank 50 and includes an aperture through which is thrust a screw 77 threadedly engaged in the wall 55. The longer leg of the bracket 76, in each case, is secured in connection with a quick disconnect clamp 79 including a spring clip portion 80. The clip portion 80 is adapted to be hooked over the lip provided on the flange 72' and into the groove 81 in its uppermost surface. The clip portion 80 is stressed, in well known manner, by a conventionally related lever 82 to clamp the flange 72', and thereby the lower end of the shell 11 of which it forms a part, to and in a coaxial alignment with the sight glass 70' and the tube 64' in which the sight glass seats.

As between the illustrations in FIGS. 4 and 5 detailing preferred methods of mounting a lower end of a cleaner unit in the frame 44, the showing in FIG. 4 is preferred. However, either showing will enable a quick assembly and disassembly of a cleaner unit and its related parts.

It is to be understood that in referring to the shell 11 the same may be a one-piece structure or comprised of segments, as desired. The important feature is the way it mounts and the fact that its head end is comprised of the head 10 which is a slip fit easily connected part.

Figure 1:
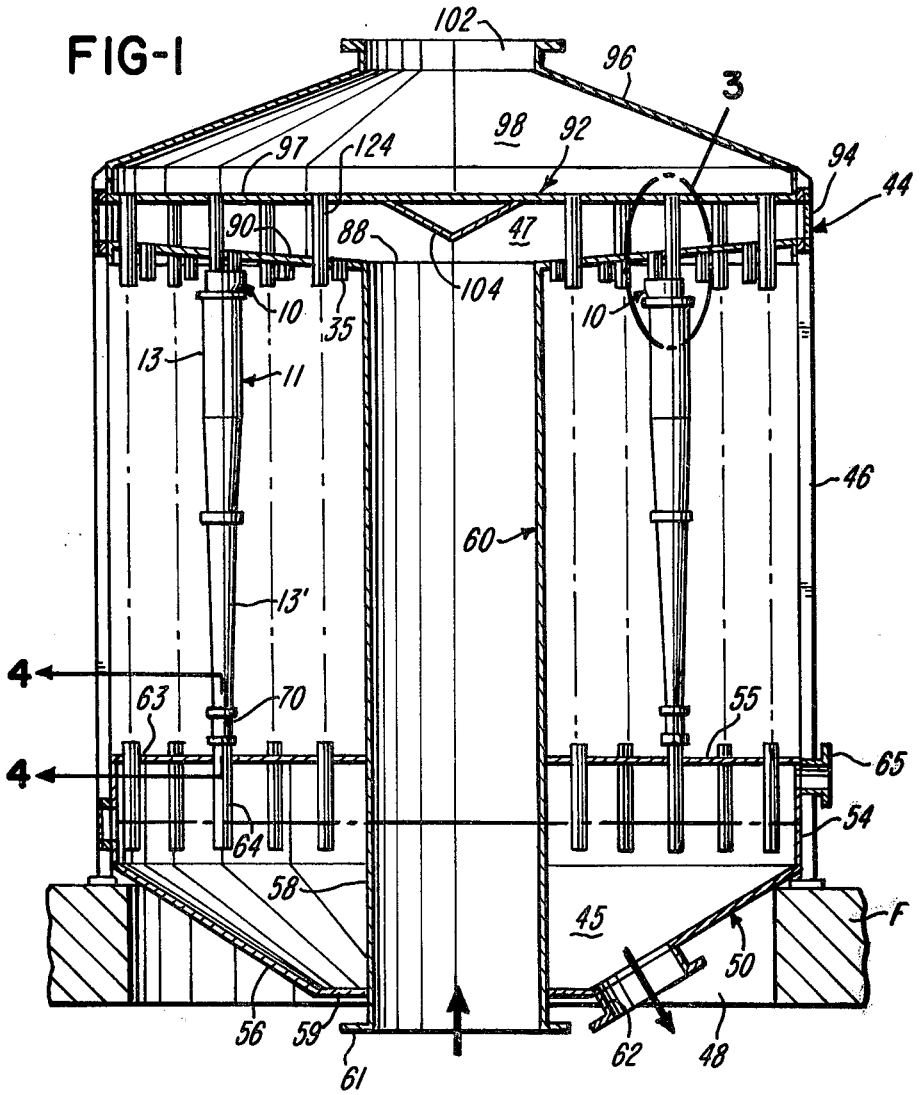
Figure 2:
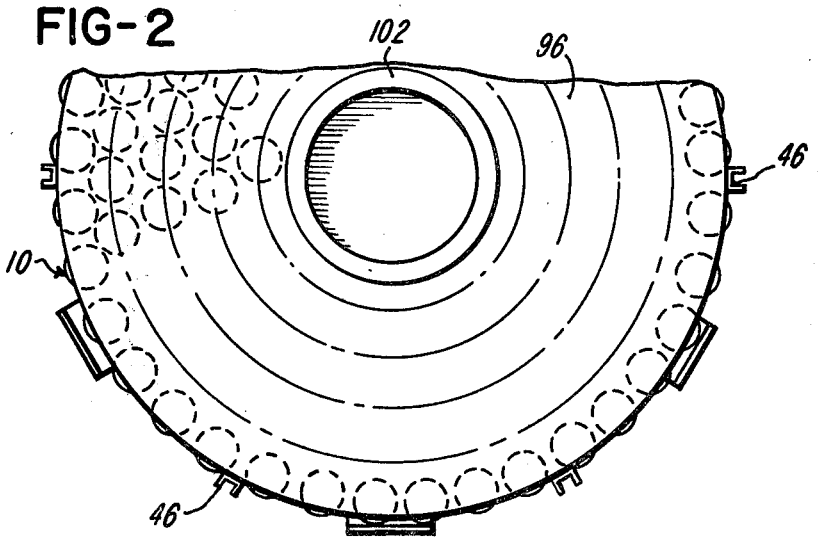
FIG. 2 is a generally diagrammatic view showing a fragment of the top of the construction of FIG. 1, parts being partially eliminated for clarity of disclosure.

As seen in FIG. 1, tube 60 rises outwardly of and central to the frame 44 to have its upper end connect in rimming relation to a central opening 88 in the bottom wall 90 of a hollow superstructure 92 which defines the supply chamber 47. The superstructure 92 is a shell the outer peripheral wall 94 of which has a cylindrical configuration and the bottom wall of which has an annular and relatively dished configuration, sloping downwardly in the direction of the tank 50 from its outer to its innermost periphery, the latter of which is integrally connected with the upper end of the tube 60. The superstructure 92 nests within and in fixed coupled relation to the upper ends of the beams 46. A shell-like cap 96 fits over the top wall of the superstructure 92 and forms therewith a discharge chamber 98 the peripheral wall of which is conically convergent in an upward sense to an opening in the top central portion of the cap which is rimmed by a cylindrically formed vertically projected flanged adapter 102. The latter is arranged for coupling the discharge chamber 98 to a suitable discharge line.

Fixed to the underside of the top wall portion of the chamber 47, in a generally coaxial, facing relation to the opening 88 defined at the upper end of the tube 60 is a downwardly convergent conical deflector 104.

The peripheral wall portion 94 of the chamber 47 is provided with a series of suitably capped, circularly spaced openings through the medium of which the chamber 47 may be inspected and/or flushed.

For the installation of the centrifugal cleaners embodying the head 10 as previously described, the vertical spacing between the top wall 55 of the tank 50 and the bottom wall 90 of the superstructure 92 will be greater than the longitudinal or vertical extent of each shell 11 together with its head 10, as seated to the upper end of a sight glass 70 which mounts in turn on and forms an axial extension of the upper end of a tube 64 or 64'.

As seen in FIG. 1, in the application thereof each shell 11 embodying a head 10 is oriented vertically to extend in parallel spaced relation to the tube 60 and between the chambers 45 and 47. As each centrifugal cleaner so provided is placed in position, the tubular projection 21 of its head 10 will be slipped over the lower dependent end of a tube 35 the upper end of which is fixed in an opening in the bottom wall 90 of the superstructure 92, the tube 35 thereby communicating the pocket 24 with the supply chamber 47. At the same time that the tubular projection 21 is slipped over the lower dependent extremity of the tube 35, the projection 19 forming an axial extension of the passage 16 and part of the overflow nozzle of the centrifugal cleaner will be slipped over the lower dependent extremity of a relatively longer tuber 124 which projects through aligned apertures in the bottom and top walls of the superstructure 92 to communicate at its upper end with the interior of the accepts discharge chamber 98. In the areas where the tubes 35 and 124 pass through or nest in openings in wall structure, a weld is provided to effect a seal therebetween. It is noted that the tube 35 depends from the bottom wall 90 of the superstructure 92 to a lesser extent than does the tube 124.

In the application of each centrifugal cleaner unit in the frame 44, the head end thereof is applied first to have the outermost ends of the projections 21 and 19 slip over the lowermost extremities of an adjacent pair of tubes 35 and 124. Suitable "O" rings will be embodied to form seals between the slip fit elements. The nature and character of such seals are well known and therefore neither shown nor particularly described. Considering a mount for the lower end of the centrifugal cleaners as illustrated in FIG. 4, initially the cleaner unit will be thrust upwardly of the lower ends of the tubes 35 and 124 to which they are coupled to have the lowermost flanged end of the shell clear the area thereunder where a sight glass 70 will be seated on and in connection with the upper end of a tube 64 which is vertically below the selected pair of tubes 35 and 124. On positioning the sight glass 70 as previously described, in superposed coaxial relation to a tubular insert 66 slip fit in the upper end of a tube 64, and being coupled thereto by a nut 68, the shell 11 and the connected head 10 may be drawn down to have the flanged end 72 of the shell seat to the flange 71 on the sight glass therebelow, whereupon the nut 68' may be coupled to the flange 72 in an obvious manner.

In the fashion described each centrifugal cleaner unit may be simply and easily slip fit and mounted to and in connection with the frame 44 to have the respective lower end thereof in communication with the rejects chamber 45 and the upper end thereof in respective connection with the supply chamber 47 and the accepts discharge chamber 98.

Should the lower mount for the centrifugal cleaner units be as shown in FIG. 5, the cleaner units may be inserted in somewhat similar fashion. In this case, upon lowering of the cleaner units each one thereof receives in the groove in the flange 72' in connection with its apex portion the upper end of a sight glass, whereupon diameterically opposite clips 80 may be quickly engaged to clamp the lower end of the centrifugal cleaner unit with which they are associated in a firm and stable relation to the sight glass and the tube therebelow which communicates with the interior of the chamber 45.

The simplicity and interrelation of the package parts in accordance with the invention is believed quite clear. The structural arrangement and its parts achieve the ultimate goal of enabling the application of cleaners to and the extraction thereof from a package in a manner essentially to avoid the need for tools. Such seals as are required are simply provided in the placement of the elements. The assembly and disassembly can substantially be fully manual in nature if so desired, and without attendent problems either in the assembly or the subsequent function of the described structure.

In the operation of the package such as illustrated in FIG. 1, slurry the contents of which are to be separated and/or cleaned may be simply delivered by way of the infeed tube 60, to be dispersed in the chamber 47 in a uniform fashion, influenced to laterally spread on impact with the deflector 104. Slurry entering the chamber 47 will overflow its dished bottom wall 90 across the openings to the tubes 35 to drop therethrough into the pockets 24 of the respective heads 10 of the centrifugal cleaner units, by way of tubular projections 21 which provide axial extensions thereof.

It will of course be obvious that with the arrangement provided the slurry will in the delivery thereof to each pocket be initially directed in a sense transverse to and above its inlet opening. This means of introduction of the slurry insures an ease of its entry to each head 10, without significant resistance, and a fast and smooth flow thereof to and through the pocket 24. This flow is accelerated in a lateral movement thereof, by way of the opening 28, to and through the restricted flow passage at the entry to the flow channel 30. As the material leaves the restricted flow passage, it will move with a predeterminable velocity. The flow of the material will be such to cause it to inherently be guided by the channel surface 32. As previously described, the configuration of channel 30 insures the immediate dispersal of heavy particles in the flow to outer limits thereof defined by the inner wall surface of the shell 11 in the example illustrated. The slurry material will flow through and exit from the channel 30, and thereby from the head 10, in a smooth vortex type flow pattern which is naturally developed in the channel and continued in movement of the flow the length of the separating chamber 12. Each centrifugal cleaner unit will conventionally function to cause a certain select lighter portion of the delivered material to move inwardly towards the central axis or core of its separating chamber 12, at which point it is induced to flow upwardly, towards the overflow end of the separating chamber, where it is channeled therefrom by way of the tubular projection 17 which provides a bell type overflow nozzle. The materials directed from the core of the separating chamber by way of the bell overflow nozzle exit by way of the passage 16 and the associated tube 124 to the discharge chamber 98, to subsequently be delivered therefrom by way of conduit means in connection with the outlet 102.

At the same time that which constitutes a light fraction of the delivered material is discharged from the overflow end of the separating chamber 12, a heavier portion of the delivered material will exit from the separating chamber by way of its rejects outlet 14, to pass to and through the associated sight glass 70 and the underlying tube 64 to the rejects chamber 45, from which it will subsequently exit by way of the outlet 62.

As previously noted, means 65 are provided to couple a source of vacuum to the upper portion of the rejects chamber 45. This gives one the option to operate the package with the reject ends of the centrifugal cleaner units, as defined by their extensions 64, in either a submerged or unsubmerged condition.

It will be self-evident that not only do we have simplicity of structure in the embodiments of the invention illustrated in FIGS. 1 to 9 of the drawings but an arrangement obviating the need for an undesirable level of pressure being required for a delivery of slurry or forced entry thereof to a centrifugal cleaner under conditions creating significant back pressure or wasting energy. It has been unexpectedly found, moreover, that the form of the special head 10 and the arrangement for the delivery of slurry in a sense generally axially of the head enables a significantly improved throughput and a substantially improved degree of cleaning efficiency for a given throughput. In addition, it will be obvious, per the invention, that one can have readily interchangeable heads 10 wherein the cross sectional area of the pockets 24 and the flow channels 30 are different so each thereof can serve in accordance with a need dictated by a particular application or a desired throughput per unit time. The substitution of one head for another may be easily and quickly achieved, indicating that with a simple inexpensive investment one can readily adapt an installation to a changing need.

In any case the arrangement for entry of slurry to and passage thereof through the head 10 appears to be of particular significance, though the particularly advantageous results achieved cannot be fully explained with the knowledge now at hand.

One point of interest is that there is little head loss or friction of significance in the entry of a slurry to the separating or cleaning units including the head 10. Consequently there is little energy loss or preceptible damage to the slurry contents.

Particular attention is directed to the fact that the invention package requires no hosing, clamping or plumbing such as normally required in the development and use of prior art canister type installations. The installation is compact and the cleaner units thereof are readily removable and reinstalled. Each and every unit and part installed is made readily available for inspection and maintenance.

Note that the dished form of the bottom wall 90 of the supply chamber 47 provides ease of cleaning of the supply chamber as well as enabling a maintenance of a velocity in supply of the material to be separated which is high enough to prevent solids from settling in the supply chamber.

In summary, the total result of the above described improvements lends efficiency and economy in installations of the type with which we are here concerned. Moreover, the invention does achieve an advantageous solution to the problems originally enumerated while lending advantages in addition thereto that were previously inobvious. A special advantage is provided by the unique character of the head 10 and by the fact that it can be simply dropped into any shell 11 and clamped in place without any special involvement of tools or labor. The configuration of the head 10 and the way in which it is utilized to have the inner wall surface of the shell 11 in which it is applied form part of its inflow channel lends further obvious benefits, both by way of manufacture and by way of insuring a particularly smooth development of an appropriate flow and a fast movement of undesirable particles to the outer limits of the flow essentially before the incoming material passes the head 10. Note should also be taken of the fact that the inclusion of the wall structure 34 in the head 10 provides that the initial portion of the flow from the pocket 24 in the head 10 is enclosed in a manner to avoid turbulence in the inflow. The result is an avoidance of reactionary forces reflecting on the under level of the inflow before it stabilizes. The total lends itself to insuring greater throughput and better cleaning with lower pressure drop in the process than would normally be expected in the use of conventional apparatus.

A modified version of the embodiment of the invention illustrated in FIG. 1 is shown in FIG. 10 of the drawings. In this case the cleaner package per the present invention includes a frame 144 similar to the frame 44. The frame 144 includes means defining vertically spaced chambers 145 and 147 mounted in connected and bridging relation to and within a plurality of circumferentially and equidistantly spaced vertical beams 146. As shown, the lower ends of the beams 146 seat in rimming relation to an aperture 148 in a floor F'. The lower or rejects chamber 145 is defined by a tank 150 the construction and configuration of which is similar to that of the tank 50. The inner peripheral wall 158 of the tank 150 is defined by a part of a vertically oriented tube 160 which is like the tube 60 except that it has a larger diameter. The end 161 of the tube 160, below the bottom apex portion of the tank 150 is bent at a 45° angle to its vertical line and has a flanged extremity for the coupling thereof to conduit means leading to a supply of slurry the contents of which are to be separated.

The upper end of tube 160 connects to rim an opening 188 in the center of the bottom wall 190 of a tank-like superstructure 192 the construction and configuration of which is like that of the superstructure 92. The superstructure 192 differs, however, in that it has an opening 199 in its top wall 197 which is coaxial with the opening 188. The opening 199 has a smaller diameter than the opening 188 and it is rimmed by the upper end of a vertical tube 200 welded in connection with the wall 197. The tube 200 depends within and in concentrically spaced relation to the tube 160 to define therewith and thereabout a passage 202 through which slurry delivered to the lower end of the tube 160 may pass to the chamber 147. The bottom wall 190 of the chamber 147 has openings arranged in concentric rings thereof, in each of which rings the openings are circularly and equidistantly spaced. Fixed to the wall 190 in each of these openings is the upper end of a short relatively dependent tube 135. The tubes 135 are identical to the tubes 35 first described and have similar function. The wall 190 has further rings of openings in each of which the openings are equidistantly spaced and have extended therethrough tubes 224 similar to the tubes 124. The tubes 224 are vertically oriented and extend through the chamber 147 and an opening in its top wall 197 to the interior of an accepts chamber 198 thereabove. The chamber 198 is created by the application of a dome-like cap 204 over the top wall 197 of the superstructure 192. The apex of the cap is conically convergent in an upward sense and truncated at its projected extremity. The cap 204 is bridged at its upper extremity by a centrally apertured plate portion 206 which has a relatively small central aperture 208 rimmed by an integrally provided vertically projected tube 210.

The lower end of the tube 200, which defines a passage from the chamber 198 by way of the opening 199, is provided with a 45° angled extension 212 commencing within the uppermost end portion of the angled extension 161 of the tube 160 and so directed as to pass through an opening in the side wall thereof. The arrangement in such that the tube 200 serves to discharge accepts from the chamber 198 at the same time that the material the contents of which are to be separated is being fed thereabout, by way of the tube 160, to the infeed or inlet chamber 147. The pipe-like projection 210 provides means for the coupling of a source of vacuum to the chamber 198 the purpose of which is to draw air from the accepts which move thereto and pass therefrom by way of the tube 200.

Chamber 145 has a discharge aperture rimmed by a relatively projected, flanged, tubular pipe segment 162 adapted for coupling to suitable conduit means providing for discharge of such rejects as may be received by the chamber 145.

As seen from FIG. 10, centrifugal cleaners comprised of the shell 11 and a slip fit head 10 such as previously described are vertically mounted betweend the tanks 150 and 192 by means and in a manner as they were in reference to the frame 44. Repetitious discussion in this respect appears unnecessary.

FIG. 11 of the drawings illustrates a further modification of the invention embodiments previously described. Demonstrated in this case is a modification of the head 10 here illustrated as 10'. The only difference between the head 10 and the head 10', essentially, is the elimination of the extensions 19 and 21. The result is that the outermost flanged end of the head 10' is defined by a surface 20' which is totally planar in configuration. The head is otherwise identical in form with that previously described. Like parts are accordingly designated with like numerals. Thus, the inlet or opening to the pocket 24' is outermost and lies in the plane of the surface 20'. There is also illustrated in FIG. 11 a provision that the uppermost end of the shell 11' which corresponds to the shell 11 includes an external flange. Thus as the head 10' is dropped in the upper or overflow end of the shell 11' its flange 22' at its outer periphery seats over the external flange about the opening to the shell 11' in which it nests. Given a modified assembly of a head 10' and shell 11' and given a package such as shown in FIG. 1 or FIG. 10 of the drawings wherein the bottom wall 290 of a superstructure such as 92 or 192 is horizontal, then the pipe-like projections 35 or 135 may be eliminated. In such case a pocket 24' of a head 10' in a centrifugal cleaner assembly may be applied directly to the bottom of a wall 290 of an infeed chamber to align with an aperture 235 therein. At the same time a tube segment 324 extending through the infeed chamber, here indicated as 247, will project below the wall 290 so that as the head 10' is abutted to the undersurface of the wall 290 the passage 16' in the head will accommodate the lower dependent extremity of the tube segment 324 to slip fit therein. Once the centrifugal cleaner assembly is applied in this manner bolts 214 can be passed through aligned apertures in the superposed flanges of the head 10' and the shell 11' and threadedly engaged in apertures in the bottom wall of the infeed chamber 247. The simplicity of use of the modified cleaners as here described is believed obvious. These modified cleaner units may be employed and arranged similarly to those previously described with reference to the frames 44 and 144 and similarly function. Of course the tube segment 324 corresponds to the tube segment 124 or 224 and is used to direct accepts to the appropriate accept discharge chamber.

From the foregoing it should be clear that the invention provides utter simplicity in construction and maximum efficiency in function of its component parts. Each embodiment features simplicity not only of fabrication but ease of assembly, maintenance and operation. The cleaner units of the invention basically provide increased throughput with equal or greater cleaning and/or separating efficiency than would normally be expected utilizing prior art apparatus directed to similar application.

The flexibility of a drop in type head for a centrifugal cleaner which in preferred embodiment integrates the overflow nozzle is unique. Also unique is the canister arrangement providing ready access to all parts of the construction and enabling the use of a much greater number of cleaners per square foot of floor space than would be enabled with conventional construction directed to similar purpose. It is obvious, of course, that the elimination of hoses and clamps lends considerable cost saving in installation and maintenance procedures. In addition to the foregoing, the package of the invention affords ease in applying vacuum to both accepts and rejects.

From the above description it will be apparent that there is thus provided a device of the character described possessing the particular features of advantage before enumerated as desirable, but which obviously is susceptible of modification in its form, proportions, detail construction and arrangement of parts without departing from the princple involved or sacrificing any of its advantages.

While in order to comply with the statute the invention has been described in language more or less specific as to structural features, it is to be understood that the invention is not limited to the specific features show, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. Apparatus for application to a tubular shell to form therewith a centrifugal separating chamber comprising a body for insertion in one end of the shell, a peripheral surface portion of said body being formed for a bearing fit with an inner wall surface portion of the shell, one end surface portion of said body being adapted to position inwardly of the shell to form one end of the separating chamber and the opposite end surface portion of said body being arranged thereby to face outwardly of the shell, said body being formed to provide therein means defining a flow path including a flow restricting inlet in said opposite end surface portion thereof arranged to open outwardly therefrom in a sense axially of said body, said inlet and the opening therefrom being offset from the central longitudinal axis of said body and located to lie within the limits of the shell to which said body is applied and arranged to be generally parallel to said longitudinal axis, said flow restricting inlet being continued inwardly of said body by means arranged to define a flow restricting passage forming part of said flow path, said passage having one end communicating with said inlet and the other end communicating with said one end surface portion of said body, the arrangement enabling an introduction of a slurry, the contents of which are to be separated, to said flow path, in a sense axially of said body, and said passage being constructed and arranged to direct slurry from said inlet to move about and axially of said body in a controlled fashion and in exit from said passage to move over said one end surface portion of said body.

2. Apparatus as in claim 1 wherein the cross-sectional area of said flow restricting passage is maintained essentially constant within the limits thereof, said peripheral surface portion of said body includes a generally cylindrical portion, said body has a central axially directed second passage and said one end surface portion of said body includes a tubular projection which forms an axial extension of said central passage and defines therewith an overflow nozzle in connection with said body.

3. Apparatus as in any one of claim 1 wherein said one end surface portion of said body is formed to provide a helically developed flow channel opening outwardly therefrom which forms a direct continuation of said flow restricting passage, said passage is narrow in width and relatively deep and the narrowness of said passage is continued by said flow channel.

4. Apparatus as in claim 1 wherein, in the application of said body to the shell, said inlet is defined by a recess which communicates with said flow restricting passage by way of a lateral opening therefrom adjacent the innermost or base portion thereof.

5. Apparatus as in claim 1 wherein said peripheral surface portion of said body formed for a bearing fit with an inner wall surface portion of the shell to which the body is applied has a generally cylindrical configuration and the portion of said flow path defined by said flow restricting passage is formed in the outer peripheral surface of said cylindrically configured body portion at a location intermediate its said end surface portions.

6. Apparatus as in claim 1 wherein, within the limits thereof, said flow restricting passage has a crosssectional area the depth to width ratio of which is approximately 3 to 1.

7. Apparatus as in claim 1 wherein said flow restricting passage is arcuate in its longitudinal extent, which is less than 360°, is narrow in its lateral extent and relatively deep and is continued by a flow channel formed about said one end surface portion of said body, which flow channel has a rapid reduction in its depth from the one end thereof connected to said passage to that end which extends to the surface which is outermost on said one end surface portion of said body.

8. Apparatus as in claim 1 wherein said flow restricting passage is arcuate in a longitudinal sense and in this sense has an arcuate extent of substantially 90°.

9. Apparatus as in claim 1 wherein said flow restricting passage is extended by a channel created by the form of said one end surface portion of said body which forms therewith a spirally developed path the arcuate extent of which is substantially 450°.

10. Apparatus as in claim 9 wherein the said path is narrow throughout its length and the major extent thereof opens from said one end surface portion of said body.

11. Apparatus providing a centrifugal cleaner as in claim 1 including a tubular shell in combination with said body wherein said body is slip fit in one end of said shell and an inner wall surface portion of said shell provides an outer side wall portion of said flow restricting passage and said inlet, and said inlet, passage and a channel in said body form a continuous flow path the major portion of which is open to and faces outwardly of said one end portion of said body.

12. Apparatus as in claim 11 wherein said body includes a central through passage providing an overflow nozzle for the separating chamber which it caps and an extended portion of said flow path is narrow and relatively deep in comparison to its width.

13. A centrifugal cleaner installation comprising means defining an infeed chamber and a rejects chamber mounted in a relatively fixed axially spaced relation by structural members which are spaced to provide free access to a space which they bound, one or more centrifugal cleaner units, means for an operative slip fit coupling of said one or more cleaner units to and between said means defining the infeed chamber and the rejects chamber, said cleaner unit including means defining a separating chamber having an overflow end and an overflow end, the overflow end of said separating chamber being communicated with said infeed chamber by way of means defining a restricted inlet to a flow path which exits to said separating chamber, said inlet being directed in generally the same sense as the longitudinal axis of said separating chamber, said inlet being arranged to open laterally to a spiral inflow passage forming part of said flow path, which is directed axially and inwardly to the overflow end of said chamber.

14. An installation as in claim 13 characterized in that said centrifugal cleaner unit includes means defining a cap for the overflow end of said separating chamber, said inlet and said inflow passage are formed in said cap, the cross-section of said spiral inflow passage is substantially constant from adjacent said inlet to the surface of said cap which is innermost, and rapidly and relatively uniformly diminishes as to its depth in the said innermost surface portion of said cap, which defines the limit of said chamber at the overflow end thereof.

15. An installation as in claim 13 including means defining a discharge passage from the underflow end of said separating chamber and means in connection with said rejects chamber defining an extension of said discharge passage to which said centrifugal cleaner is end abutted and freely fit in the slip fit coupling thereof between said infeed and said rejects chambers, by means of which said separating chamber is communicated with said rejects chamber.

16. An installation as in claim 13 wherein said structural members are vertically extending laterally spaced rigidifying members which define an open framework within which said one or more centrifugal cleaner units are positioned with free access thereto.

17. Apparatus as set forth in claim 16 wherein said open framework is vertically oriented to position said infeed chamber at the top and said rejects chamber at the bottom thereof, and means defining an infeed passage for material the constituents of which are to be separated and/or cleaned is positioned centrally of said frame and connected to discharge to said means defining said infeed chamber, there being a plurality of said centrifugal cleaner units similarly slip fit to and positioned between said means respectively defining said infeed chamber and said rejects chamber and similarly communicating their separating chambers with said infeed chamber and said rejects chamber and said means defining said infeed chamber is constructed and arranged to receive material from said infeed passage and disperse said material in a flow laterally thereof and includes means defining exit passages therefrom arranged for a respectively direct and coaxial connection with feed inlets of the applied cleaner units whereby to cause the material to move from said infeed chamber to each cleaner unit in a direct axial flow.

18. Apparatus for providing an installation of centrifugal cleaners comprising means defining an infeed chamber, means defining a rejects chamber, means mounting said chambers in an axially spaced relation, one or more centrifugal cleaner units mountable in the space between said chambers, said chamber mounting means being an open framework arranged to provide free access for a lateral insertion of said one or more centrifugal cleaner units for positioning thereof in axial alignment with openings to and from said chambers, each cleaner unit being comprised of a tubular shell having an overflow end and an underflow end and means capping its overflow end to form therein a separating chamber, a restricted axially oriented inlet being defined at the outermost portion of said capping means and arranged to align with one of said openings in said means defining said infeed chamber, to receive directly therefrom, in a coaxial flow, the material to be separated, a flow restricting passage formed to follow and form an extension of said inlet having a discharge end which opens to an innermost surface portion of said capping means, which defines one end of said separating chamber, in an arrangement providing that the material to be separated or cleaned is caused to move to and through the separating chamber in a vortex-like flow pattern, said flow restricting passage being substantially constant as to its cross-sectional area and thereby determining the effective separation of materials which pass therethrough in the movement thereof to and through said separating chamber.

19. Apparatus as in claim 18 wherein said means defining said infeed chamber and its connections with each centrifugal cleaner unit applied are constructed and arranged to provide for movement of material therein to each cleaner unit by passing the material across the opening from said infeed chamber with which the restricted inlet of the cleaner unit is aligned, whereby to introduce the material to said cleaner unit by way of a direct line axial flow thereof from the infeed chamber to the cleaner unit.

20. Apparatus as in claim 10 wherein said capping means includes an outermost surface portion which has a generally planar configuration constructed and arranged for the positioning thereof in a sealing abutment with a wall portion of said means defining said infeed chamber to cause said axial inlet to form a direct restricted extension of said one of said openings in said means defining said infeed chamber with which it aligns.

21. Apparatus as in claim 18 wherein said axially oriented inlet has a pocket-like configuration a wall portion of which has an opening laterally thereof to one end of said flow restricting passage and said passage is extended at its other end, which is exposed to said separating chamber, by a flow channel at the innermost surface of said capping means, the portion of said flow channel adjacent said other end of said passage being relatively deep and said flow channel being sharply sloped at its base to quickly reduce in depth so as to provide that the materials leaving said passage will have a smooth rapidly moving flow which is inherently maintained as the material passes to and through said separating chamber in an induced vortex type flow pattern.

22. Apparatus as in claim 18 wherein said capping means is a separable body which is adapted for a bearing slip fit in the overflow end of said tubular shell.

23. Apparatus as in claim 18 including slip fit coupling means for operatively connecting and mounting each said centrifugal cleaner unit by a slip fit application thereof of means embodied in connection with one of said means respectively defining said infeed and said rejects chambers, said coupling means being constructed and arranged to accommodate an axial movement of the centrifugal cleaner unit to facilitate both the installation thereof and removal thereof from an operative connection to both said chambers.

24. Apparatus as in claim 18 wherein said means defining said infeed chamber includes spaced relatively facing wall portions between which materials to be separated or cleaned are delivered, one of said facing wall portions includes said openings for respective alignment with an axial inlet of a capping means of an applied centrifugal cleaner unit, said capping means having means defining, therein and in connection therewith, an outlet from the separating chamber of the centrifugal cleaner unit of which it forms a part which extends through, bridges said spaced wall portions, is sealed from said infeed chamber and serves to channel from said separating chamber a predetermined portion of the materials which are separated in passage through said separating chamber, means defines a discharge chamber for said predetermined portion of said materials to the side of said means defining said infeed chamber remote from said centrifugal cleaner units a discharge passage from which is directed through at least a portion of means defining an infeed passage which is connected to deliver materials to said infeed chamber.

25. Apparatus as in claim 24 wherein said means defining said discharge passage has at least a portion thereof positioned concentric with and in spaced relation to a portion of said means defining said infeed passage.

26. Apparatus as in claim 18 wherein a slip fit coupling is provided between said means defining said infeed chamber and the capping means of said one or more centrifugal cleaners, facilitating the slip fit application of said cleaners in the first instance.

27. Apparatus for providing an installation of centrifugal cleaners comprising means defining an infeed chamber, means defining a rejects chamber, means mounting said chambers in an axially spaced relation, one or more centrifugal cleaner units mountable in the space between said chambers, said chamber mounting means being arranged to provide free access for a lateral insertion of said one or more centrifugal cleaner units for positioning thereof in axial alignment with openings to and from said chambers, each cleaner unit being comprised of a tubular shell having an overflow end and an underflow end and means capping its overflow end to form therein a separating chamber, means defining a restricted inlet oriented axially and directed inwardly of the outermost surface of said capping means, arranged to align with one of said openings in the means defining said infeed chamber, to receive directly therefrom, in a coaxial flow, the material to be separated, said capping means including in the body thereof a relatively short flow restricting passage forming a continuation of said inlet and having a discharge end which opens to the innermost surface of said capping means, which defines one end of said separating chamber, in an arrangement providing that the material to be separated or cleaned is caused to move to and through the separating chamber in a vortex-like flow pattern, the means defining said axially oriented inlet having an opening thereto defined by means forming an extension thereof telescopically related to means defining a tubular extension of said one opening in the said means defining said infeed chamber which aligns therewith, and said means defining said infeed chamber being arranged to deliver material to said axially oriented inlet by a flow of said materials in a direction which is over said one aligned opening and in a sense generally transverse thereto.

28. Apparatus for providing an installation of centrifugal cleaners comprising means defining an infeed chamber, means defining a rejects chamber, means mounting said chambers in an axially spaced relation, one or more centrifugal cleaner units mountable in the space between said chambers, said chamber mounting means being arranged to provide free access for a lateral insertion of said one or more centrifugal cleaner units for positioning thereof in axial alignment with openings to and from said chambers, each cleaner unit being comprised of a tubular shell having an overflow end and an underflow end and means capping its overflow end to form therein a separating chamber, said capping means including at the outermost end thereof an axial inlet arranged to align with one of said openings in said means defining said infeed chamber, to receive directly therefrom, in a coaxial flow, the material to be separated, said capping means including in the body thereof a relatively short flow restricting passage forming a continuation of said inlet and having a discharge end which opens to the innermost surface of said capping means, which defines one end of said separating chamber, in an arrangement providing that the material to be separated or cleaned is caused to move to and through the separating chamber in a vortex-like flow pattern, said means defining said infeed chamber including spaced relatively facing wall portions between which materials to be separated or cleaned and delivered, one of said facing wall portions including said openings for respective alignment with an axial inlet of a capping means of an applied centrifugal cleaner unit, said capping means having means defining, therein and in connection therewith, an outlet from the separating chamber of the centrifugal cleaner unit of which it forms a part which extends through, bridges said spaced wall portions, is sealed from said infeed chamber and serves to channel from said separating chamber a predetermined portion of the materials which are separated in passage through said separating chamber, said means defining an outlet in and in connection with said capping means including telescopically related pipe-like structures one of which projects through said infeed chamber and has a slip fit with another which defines the portion of said outlet in said capping means, and one of said facing wall portions including therein, adjacent said one pipe-like structure, one of said openings which align with the axial inlet in the related centrifugal cleaner unit in which is connected one end of a tube segment arranged to project and to slip fit with and form an extension of the means defining said axially oriented inlet, providing thereby that the said related centrifugal cleaner unit may be slip fit to couple the same with said one pipe-like structure and said tube segment and in a predetermined orientation with reference to said means defining said infeed chamber.

* * * * *

UNITED STATES PATENT OFFICE

CERTIFICATE OF CORRECTION

Patent No. 4,148,721 Dated April 10, 1979

Inventor(s) David L. Brown et al.

It is certified that error appears in the above-identified patent and that said Letters Patent are hereby corrected as shown below:

Col. 17, line 62 (Claim 13, line 11) "overflow" (1st occurrence) is corrected to read -- underflow --.

Col. 19, line 50 (Claim 23, line 4) "of" (first occurrence) is corrected to read -- to --.

Col. 21, line 14 (Claim 28, line 28) "and" is corrected to read -- are --.

Signed and Sealed this

*Twenty-fifth* Day of *September 1979*

[SEAL]

*Attest:*

*Attesting Officer*

LUTRELLE F. PARKER

*Acting Commissioner of Patents and Trademarks*

UNITED STATES PATENT AND TRADEMARK OFFICE

CERTIFICATE OF CORRECTION

PATENT NO. : 4,148,721

DATED : April 10, 1979

INVENTOR(S) : David L. Brown et al.

It is certified that error appears in the above—identified patent and that said Letters Patent is hereby corrected as shown below:

Column 19, Claim 20, line 6, "axial" should read -- restricted -

Claim 20, lines 6 and 7, "restricted" should read -- axial --.

Signed and Sealed this

*Eighteenth* Day of *March 1980*

[SEAL]

*Attest:*

SIDNEY A. DIAMOND

*Attesting Officer*

*Commissioner of Patents and Trademarks*